US006698513B1

(12) United States Patent
Yokley

(10) Patent No.: US 6,698,513 B1
(45) Date of Patent: Mar. 2, 2004

(54) APPARATUS FOR USE IN CEMENTING AN INNER PIPE WITHIN AN OUTER PIPE WITHIN A WELLBORE

(75) Inventor: John N Yokley, Kingwood, TX (US)

(73) Assignee: Dril-Quip, Inc., Houston, TX (US)

( * ) Notice: Subject to any disclaimer, the term of this patent is extended or adjusted under 35 U.S.C. 154(b) by 0 days.

(21) Appl. No.: 10/136,992

(22) Filed: May 2, 2002

Related U.S. Application Data

(60) Provisional application No. 60/292,049, filed on May 18, 2001.

(51) Int. Cl.[7] ..... E21B 33/13

(52) U.S. Cl. ..... 166/177.4; 166/150

(58) Field of Search ..... 166/285, 291, 166/153, 156, 177.4

(56) References Cited

U.S. PATENT DOCUMENTS 4,171,019 A * 10/1979 Cole ..... 166/341
5,553,672 A 9/1996 Smith, Jr. et al. ..... 166/382

* cited by examiner

*Primary Examiner*—William Neuder
(74) *Attorney, Agent, or Firm*—Browning Bushman, P.C.

(57) ABSTRACT

There is disclosed apparatus for use in cementing a liner within an outer casing, wherein a ball is lowered into a diverter and thus guided into a pocket in one side thereof to permit passage of a pump down plug into a lower wiper plug.

5 Claims, 5 Drawing Sheets

APPARATUS FOR USE IN CEMENTING AN INNER PIPE WITHIN AN OUTER PIPE WITHIN A WELLBORE

This application claims the benefit of Provisional Application No. 60/292,049, filed May 18, 2001 and assigned to the assignee of the present application.

This invention relates generally to apparatus for use in cementing an inner pipe within an outer pipe installed within a wellbore. More particularly, it relates to improvements in apparatus of this type in which the cementing operation requires the sequential lowering of balls and pump down plugs within the inner pipe. In the preferred and illustrated embodiment, the inner pipe is a liner having an upper end installed within an outer casing by a column of cement pumped out the lower end of the liner into the annulus between it and the outer casing.

Conventionally, in a system of this type, a ball is dropped onto a seat in the bore of the liner to permit circulating fluid to be directed into a portion thereof for hydraulically actuating a part in the system external to the liner bore. More particularly, an opening on which the ball is seated may be circumferentially yieldable, upon application of higher circulating pressure, to cause the ball to pass therethrough and out the lower end of the liner. The ball may then be followed by a pump down plug to force the cement downwardly through the lower end of the liner and into the annulus between it and the outer casing.

In the system shown and described in the aforementioned provisional application, the ball is relatively large, and, in any case larger than the bore of the liner wiper plugs (LWP) into which the pump down plugs (PDP) are to be installed. Unless, the bore through the wiper plug is as small as possible, the inner diameter of the liner to be cemented in the outer hanger is necessarily enlarged to accommodate the wiper plugs which are carried about it. Consequently, it is the object of this invention to provide apparatus for such a system in which the balls may be substantially larger than the pump down plugs, and thus larger than the bore through the wiper plugs in which the pump down plugs are to be landed.

This and other objects are accomplished, by apparatus which includes a tubular member such as a liner having an upper end connected to a well pipe for lowering into a casing in the well to permit it to be cemented therein, and having a bore with a relatively large diameter upper portion and a relatively smaller diameter lower portion. The larger portion enables one or more balls to be lowered therethrough, but the LWP in the smaller diameter portion prevents passage of the balls while permitting passage of the pump down plugs into the liner wiper plug.

For this purpose, a sub installed beneath the larger portion has a pocket to one side of its bore into which the ball, or at least a portion of it, diverted to thereby permit the pump down plug to pass between the ball and the side of the sub opposite the pocket, whereby the pump down plug may continue downwardly to enter the liner wiper plug. The sub also includes a ramp extending across the bore of the sub and slanting downwardly toward the pocket so that, when the ball is dropped, it will land on the ramp and thus be guided into the slot. More particularly, the ramp has a U-shaped slot which is too narrow to pass a ball but is wide enough to pass a plug down between its closed end and the inner side of the diverted ball.

BRIEF DESCRIPTION OF THE DRAWINGS

In the drawings, wherein like references characters are used throughout.

Figure 1:
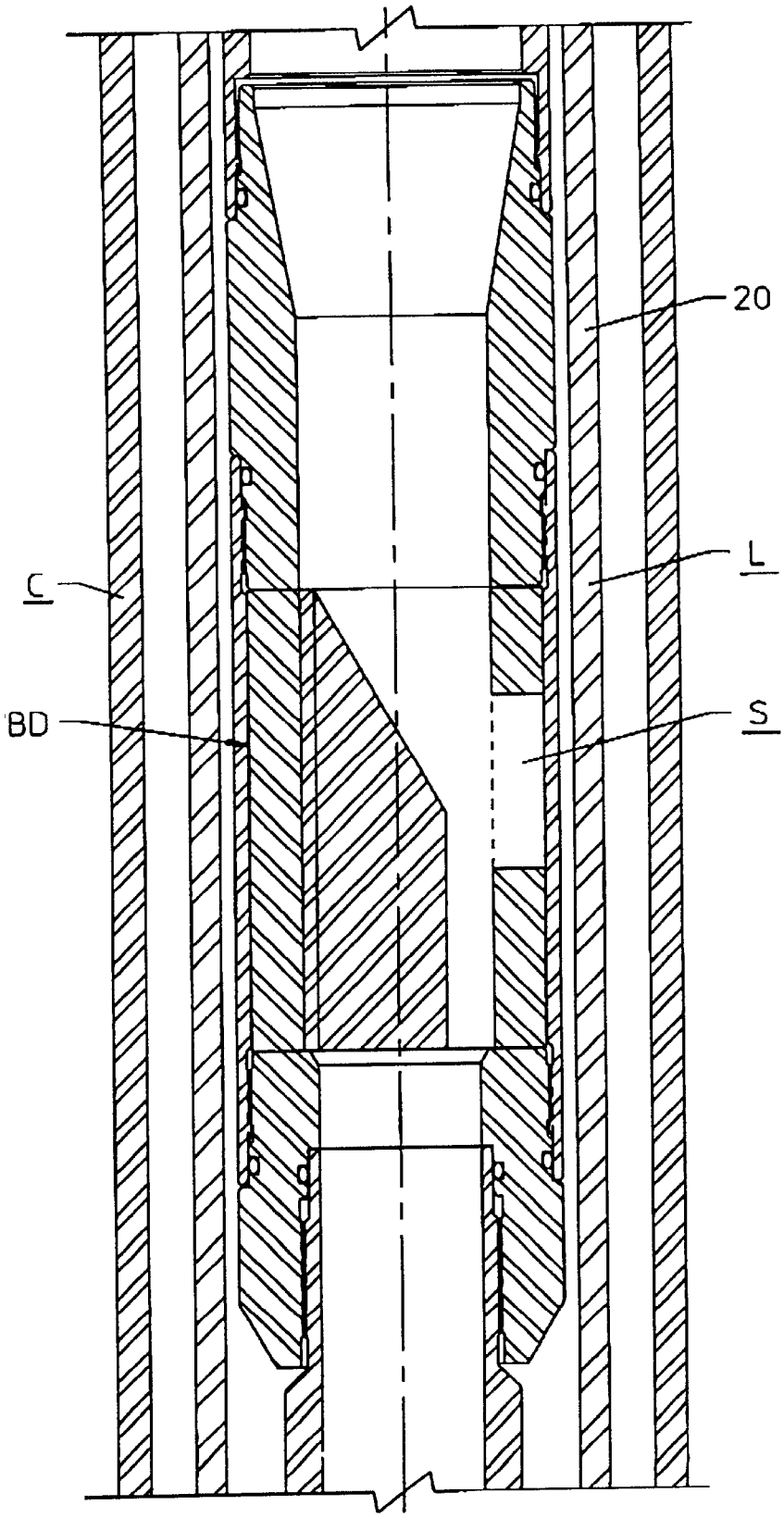
FIG. 1 is a vertical sectional view of the diverter including the sub from which the cementing assembly is suspended.
Figure 2:
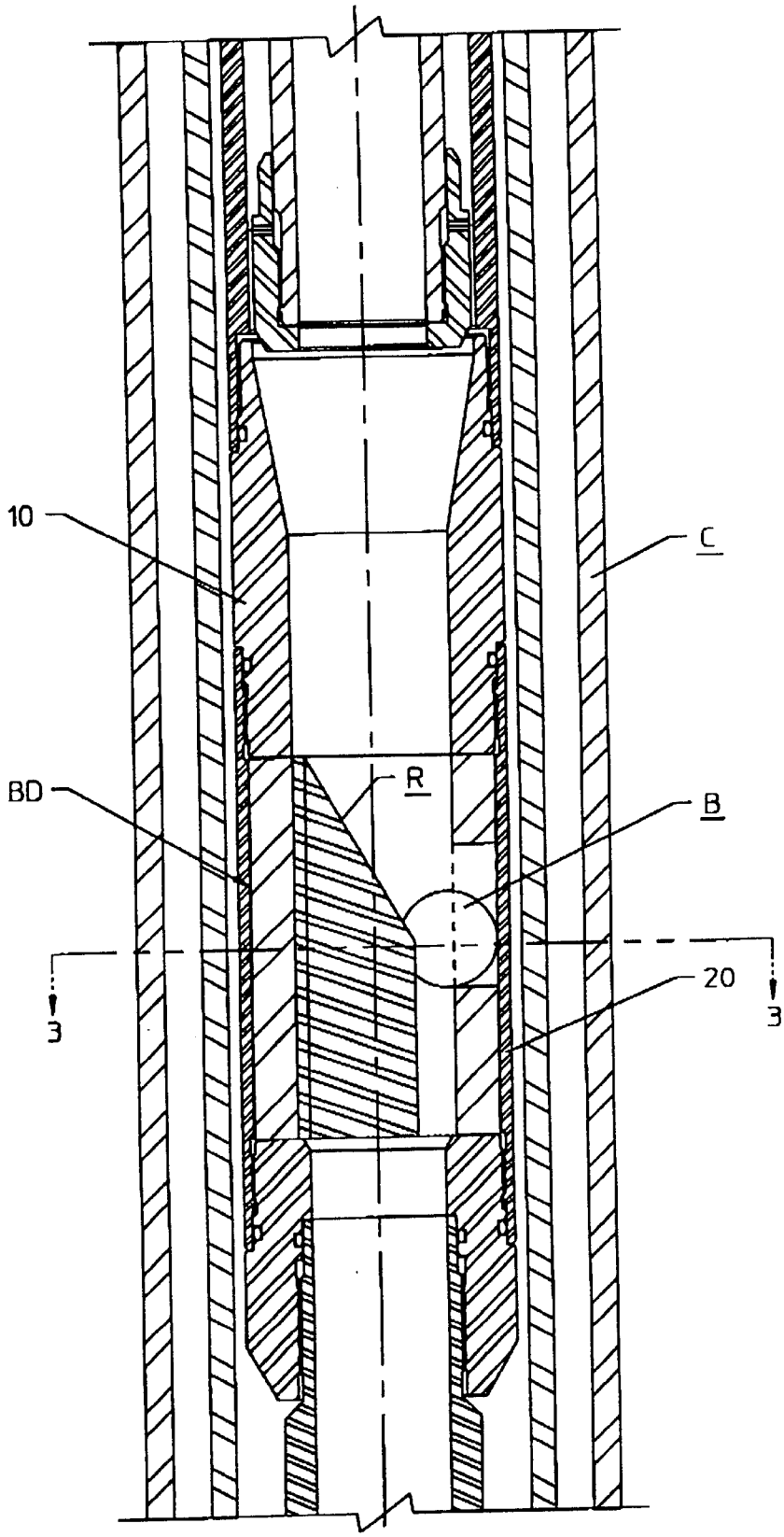
FIG. 2 is a view similar to FIG. 1, with a ball landed in the diverter pocket.
Figure 4:
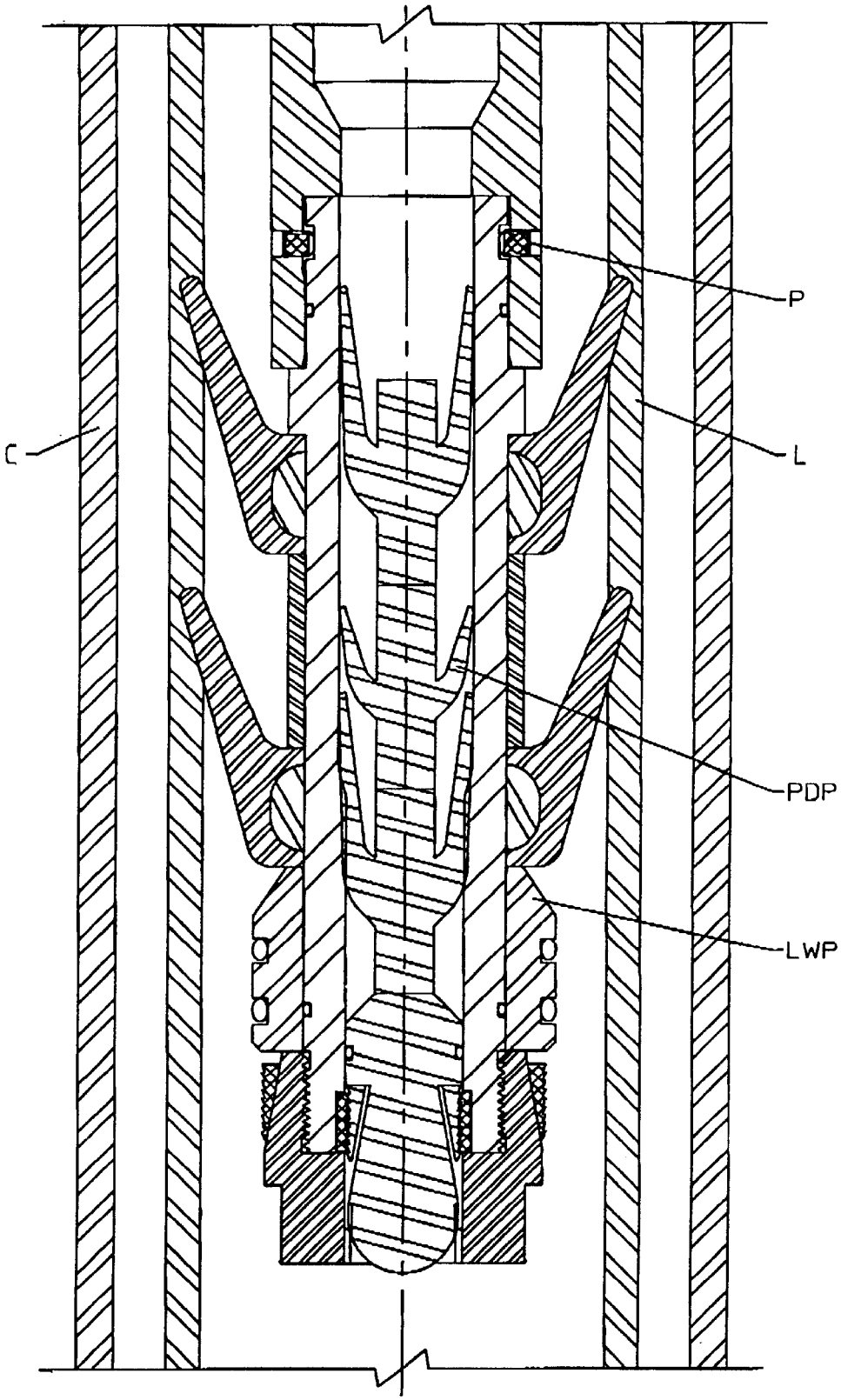
FIG. 4 is another vertical sectional view of the liner beneath the diverter and showing the pump down plug following passage through the slot in the ramp and into a landed position in the liner wiper plug of the cementing equipment.

With reference now to the details of the above described drawings, each of FIGS. 1, 2 and 4 shows, in vertical cross section, a tubular member 10 suspended within a liner L installed within an outer casing C within a wellbore, its purpose being to circulate cement downwardly through the lower portion of the tubular member and into the annulus between the liner and the casing to cement the liner within the casing. As also shown in FIGS. 4 and 5, a liner wiper plug LWP is suspended from the tubular member with a pump down plug is installed therein.

The ball diverter BD comprises a sub which is installed between the upper and lower portions of the tubular member, and has a pocket P formed in side of the sub to receive a portion of a ball B adapted to pass downwardly through the tubular member. A ramp R mounted the sub end has an upper face which is slanted downwardly from its upper end to its lower end to terminate opposite the pocket P. A slot S in the ramp is narrower than the ball, so that when the ball is dropped through the running tool and into the upper end of the tubular member of the cementing tool, it will be guided into the pocket.

Figure 3:
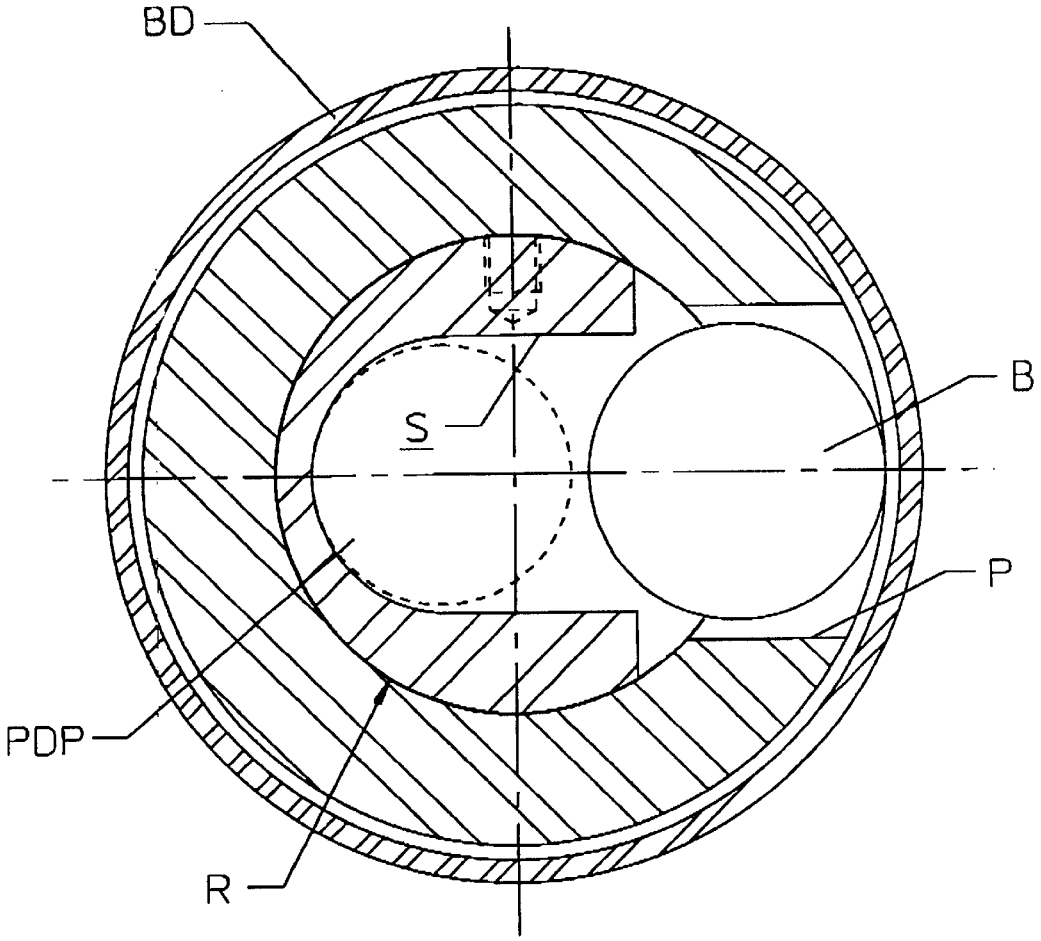
FIG. 3 is a cross sectioned view of the diverter, as seen along broken lines 3—3 of FIG. 2, but on a larger scale to illustrate the "U" shaped slot formed in the ramp to one side of the diverted ball to permit passage of a pump down plug.

As shown in FIG. 3, the opening between the inner end of the slot permits the lips of the pump down plug to flex inwardly so that the pump down plug is free to continue downwardly to a seated position in the liner wiper plug LWP, as shown in FIG. 4. That is, following dropping of the ball into the pocket, the pump down plug will, under the influence of downwardly directed circulating fluid, pass between the ball and closed end of the slot in the ramp. The pump down plug continues to be lowered until it lands in the liner wiper plug, as shown in FIG. 4, thus closing the lower end of the bore through the tubular member, all in a matter well known in the art.

Figure 5:
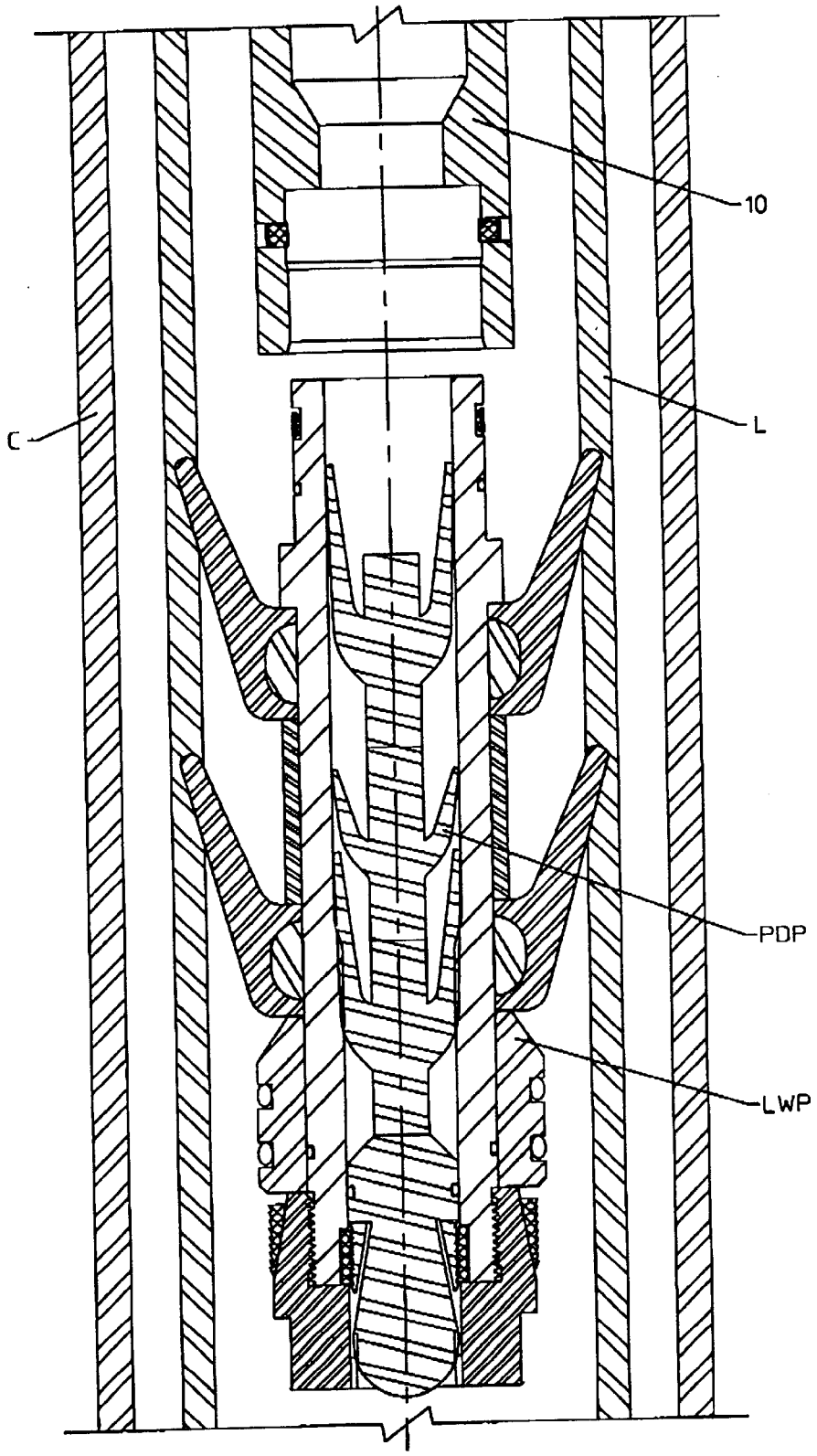
FIG. 5 is a further vertical sectional view, but in which the connection of the wiper plug has been sheared from the lower end of the tubular member beneath the ball diverter.

Increased pressure of the circulating fluid shears the pin P holding the liner wiper plug in place to permit liner wiper plug to be moved downwardly in the liner, as shown in FIG. 5. Thus, the released plug assembly will continue to force the cement downwardly through the liner and then upwardly within the annulus between the liner and into the outer casing, whereby the liner may be cemented within the casing, all in the manner well known in the art.

Various other modifications to the apparatus disclosed herein should be apparent from the above description of the preferred embodiments. Although the invention has thus been described in detail for this embodiment, it should be understood that this explanation is for illustration, and that the invention is not limited to this embodiment.

What is claimed is:

1. A downhole cementing tool, comprising:

a tubular member having an upper end for lowering into a well bore to permit it to be cemented therein, and having a bore with a relatively large diameter upper portion enabling one or more balls and a pump down plug to be lowered therein and a smaller lower portion including a liner wiper plug whose bore is smaller than the ball but permits passage of the pump down plug therethrough;

a diverter within the tubular member intermediate the upper and lower portions and having a side pocket to one side of the bore to receive the ball; and a ramp having a downwardly slanted upper surface to guide the ball into the side pocket and prevent passage of the ball through the tubular member, and to pass the pump down plug when the ball is in the pocket.

2. A downhole cementing tool as defined in claim 1, wherein the diverter is provided in a sub connected to a lower end of the large diameter upper portion.

3. A downhole cementing tool as defined in claim 1, wherein the tubular member is positioned within a liner.

4. A downhole cementing tool as defined in claim 1, wherein the liner wiper plug and the plug are releasedly connected to the tubular member.

5. A downhole cementing tool as defined in claim 1, wherein the ramp has a generally U-shaped opening facing the pocket.

* * * * *

UNITED STATES PATENT AND TRADEMARK OFFICE

CERTIFICATE OF CORRECTION

PATENT NO. : 6,698,513 B1
DATED : March 2, 2004
INVENTOR(S) : John M. Yokley

It is certified that error appears in the above-identified patent and that said Letters Patent is hereby corrected as shown below:

Title page,
Item [75], Inventor, please change the name of the inventor from "John N Yokley", to -- John M. Yokley --.

Signed and Sealed this

First Day of June, 2004

JON W. DUDAS
*Acting Director of the United States Patent and Trademark Office*